US011599056B2

(12) United States Patent
Fahmy et al.

(10) Patent No.: US 11,599,056 B2
(45) Date of Patent: Mar. 7, 2023

(54) GROOVED PHOTOCONDUCTIVE DRUM END CAP

(71) Applicant: LEXMARK INTERNATIONAL, INC., Lexington, KY (US)

(72) Inventors: Alfred Louis Fahmy, Lexington, KY (US); Kyle Benjamin Freels, Georgetown, KY (US); Jody Evan McCoy, Stanton, KY (US)

(73) Assignee: Lexmark International, Inc., Lexington, KY (US)

( * ) Notice: Subject to any disclaimer, the term of this patent is extended or adjusted under 35 U.S.C. 154(b) by 0 days.

(21) Appl. No.: 17/573,989

(22) Filed: Jan. 12, 2022

(65) Prior Publication Data

US 2023/0025282 A1 Jan. 26, 2023

Related U.S. Application Data

(60) Provisional application No. 63/224,036, filed on Jul. 21, 2021.

(51) Int. Cl.
*G03G 15/00* (2006.01)
*G03G 21/16* (2006.01)

(52) U.S. Cl.
CPC ..... *G03G 15/751* (2013.01); *G03G 15/80* (2013.01); *G03G 21/1647* (2013.01); *G03G 21/1652* (2013.01); *G03G 21/1671* (2013.01)

(58) Field of Classification Search
CPC .... G03G 15/751; G03G 15/757; G03G 15/80; G03G 21/1647; G03G 21/1652; G03G 21/1671; H01R 39/025; H01R 39/64
See application file for complete search history.

(56) References Cited

U.S. PATENT DOCUMENTS

| | | | | |
|---|---|---|---|---|
| 5,345,294 | A * | 9/1994 | Nomura | G03G 15/751 399/90 |
| 7,050,736 | B2 | 5/2006 | Hale et al. | |
| 10,185,279 | B1 * | 1/2019 | Sadik | H01R 39/64 |
| 2007/0253734 | A1 * | 11/2007 | Shin | G03G 15/751 399/159 |
| 2017/0364019 | A1 * | 12/2017 | Onishi | G03G 15/757 |
| 2022/0043386 | A1 * | 2/2022 | Hori | G03G 21/1647 |

* cited by examiner

*Primary Examiner* — Sophia S Chen
(74) *Attorney, Agent, or Firm* — Justin M. Tromp

(57) ABSTRACT

A photoconductive drum for an electrophotographic image forming device according to one example embodiment includes a cylindrical drum member. A shaft defines a rotational axis of the photoconductive drum. An end cap is positioned at an axial end of the drum member. An electrical contact is positioned against an axially inboard side of the end cap. The electrical contact electrically connects the shaft to the drum member. The electrical contact includes a plurality of projections that contact an inner circumferential surface of the drum member. A plurality of grooves are formed in an outer circumferential surface of the end cap.

16 Claims, 8 Drawing Sheets

GROOVED PHOTOCONDUCTIVE DRUM END CAP

CROSS REFERENCES TO RELATED APPLICATIONS

This application claims priority to U.S. Provisional Patent Application Ser. No. 63/224,036, filed Jul. 21, 2021, entitled "Grooved Photoconductive Drum End Cap," the content of which is hereby incorporated by reference in its entirety.

BACKGROUND

1. Field of the Disclosure

The present disclosure relates generally to electrophotographic image forming devices and more particularly to a grooved photoconductive drum end cap.

2. Description of the Related Art

During a print operation by an electrophotographic image forming device, a charge roll charges the surface of a photoconductive drum to a predetermined voltage. The charged surface of the photoconductive drum is then selectively exposed to a laser light source to selectively discharge the surface of the photoconductive drum and form an electrostatic latent image on the photoconductive drum corresponding to the image being printed. Toner is picked up by the latent image on the photoconductive drum from a developer roll, creating a toned image on the surface of the photoconductive drum. The toned image is then transferred from the photoconductive drum to the print media, either directly by the photoconductive drum or indirectly by an intermediate transfer member. A cleaning blade or roller removes any residual toner adhering to the photoconductive drum after the toner is transferred from the photoconductive drum. The cleaned surface of the photoconductive drum is then ready to be charged again and exposed to the laser light source to continue the printing cycle.

Various imaging components, such as the photoconductive drum, charge roll, developer roll, etc., require electrical voltage from a power supply of the image forming device in order to electrostatically move toner from one component to another, such as from the developer roll to the latent image on the surface of the photoconductive drum and from the surface of the photoconductive drum to the print media or intermediate transfer member. Print defects may occur if electrical contact to these imaging components is not maintained consistently, such as if electrical contact is interrupted or shorted. For example, metal and conductive plastic shavings and other forms of debris may cause electrical shorts within an electrophotographic image forming device, disrupting the electrical connection to one or more imaging components. Non-conductive debris can also contaminate imaging components, potentially causing print defects.

Accordingly, improved imaging components for maintaining reliable electrical connections and minimizing debris are desired.

SUMMARY

A photoconductive drum for an electrophotographic image forming device according to one example embodiment includes a cylindrical drum member. A shaft defines a rotational axis of the photoconductive drum. An end cap is positioned at an axial end of the drum member. An electrical contact is positioned against an axially inboard side of the end cap. The electrical contact electrically connects the shaft to the drum member. The electrical contact includes a plurality of projections that contact an inner circumferential surface of the drum member. A plurality of grooves are formed in an outer circumferential surface of the end cap.

In some embodiments, the plurality of grooves extend in an axial direction relative to the rotational axis of the photoconductive drum, and the plurality of grooves are angularly aligned with the plurality of projections of the electrical contact.

In some embodiments, contact portions of an outer circumferential surface of the end cap are in contact with the inner circumferential surface of the drum member. Recessed portions of the outer circumferential surface of the end cap are angularly aligned with the plurality of projections of the electrical contact, and the recessed portions of the outer circumferential surface of the end cap are spaced from the inner circumferential surface of the drum member.

In some embodiments, the plurality of grooves are aligned with the plurality of projections of the electrical contact such that deformities on the inner circumferential surface of the drum member caused by contact with the plurality of projections of the electrical contact do not contact the outer circumferential surface of the end cap when the end cap is pressed into the axial end of the drum member in an axial direction relative to the rotational axis of the photoconductive drum.

BRIEF DESCRIPTION OF THE DRAWINGS

The accompanying drawings incorporated in and forming a part of the specification, illustrate several aspects of the present disclosure, and together with the description serve to explain the principles of the present disclosure.

DETAILED DESCRIPTION

In the following description, reference is made to the accompanying drawings where like numerals represent like elements. The embodiments are described in sufficient detail to enable those skilled in the art to practice the present disclosure. It is to be understood that other embodiments may be utilized and that process, electrical, and mechanical changes, etc., may be made without departing from the scope of the present disclosure. Examples merely typify possible variations. Portions and features of some embodiments may be included in or substituted for those of others. The following description, therefore, is not to be taken in a limiting sense and the scope of the present disclosure is defined only by the appended claims and their equivalents.

Figure 1:
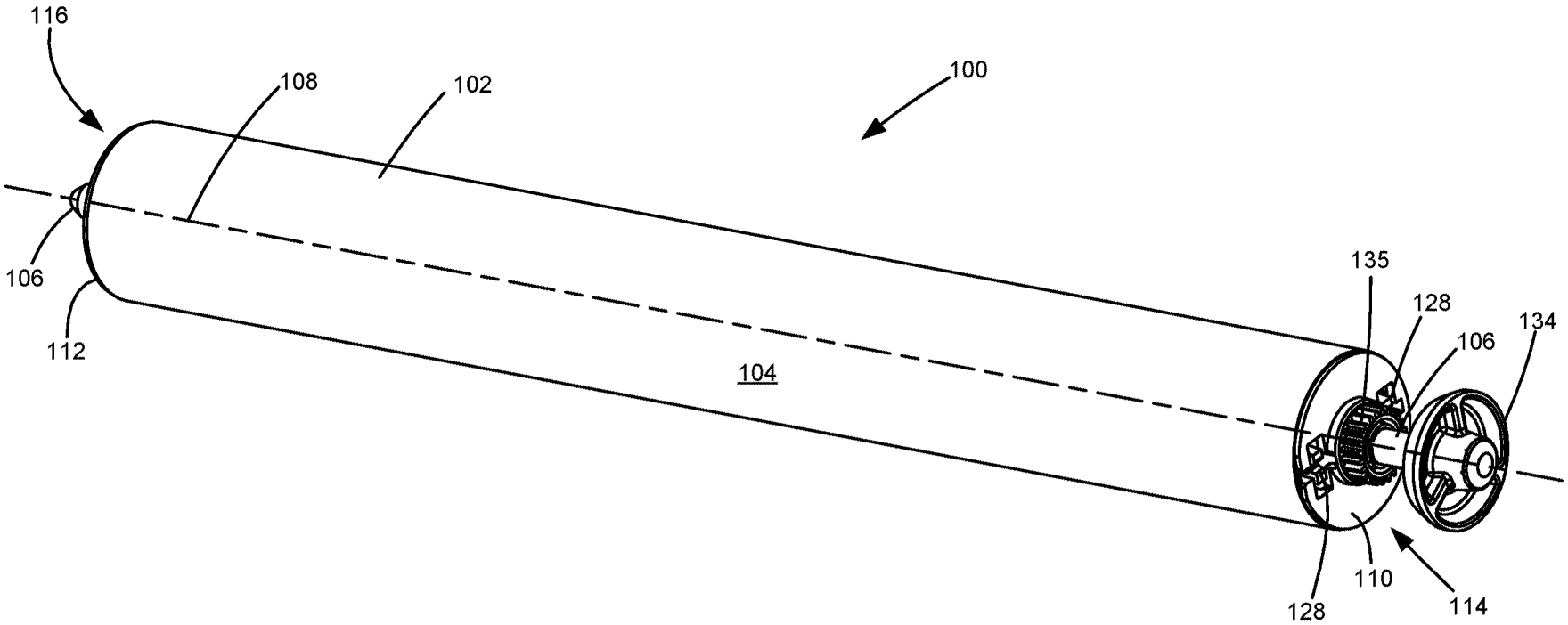
FIG. 1 is a perspective view of a photoconductive drum according to one example embodiment.
Figure 2:
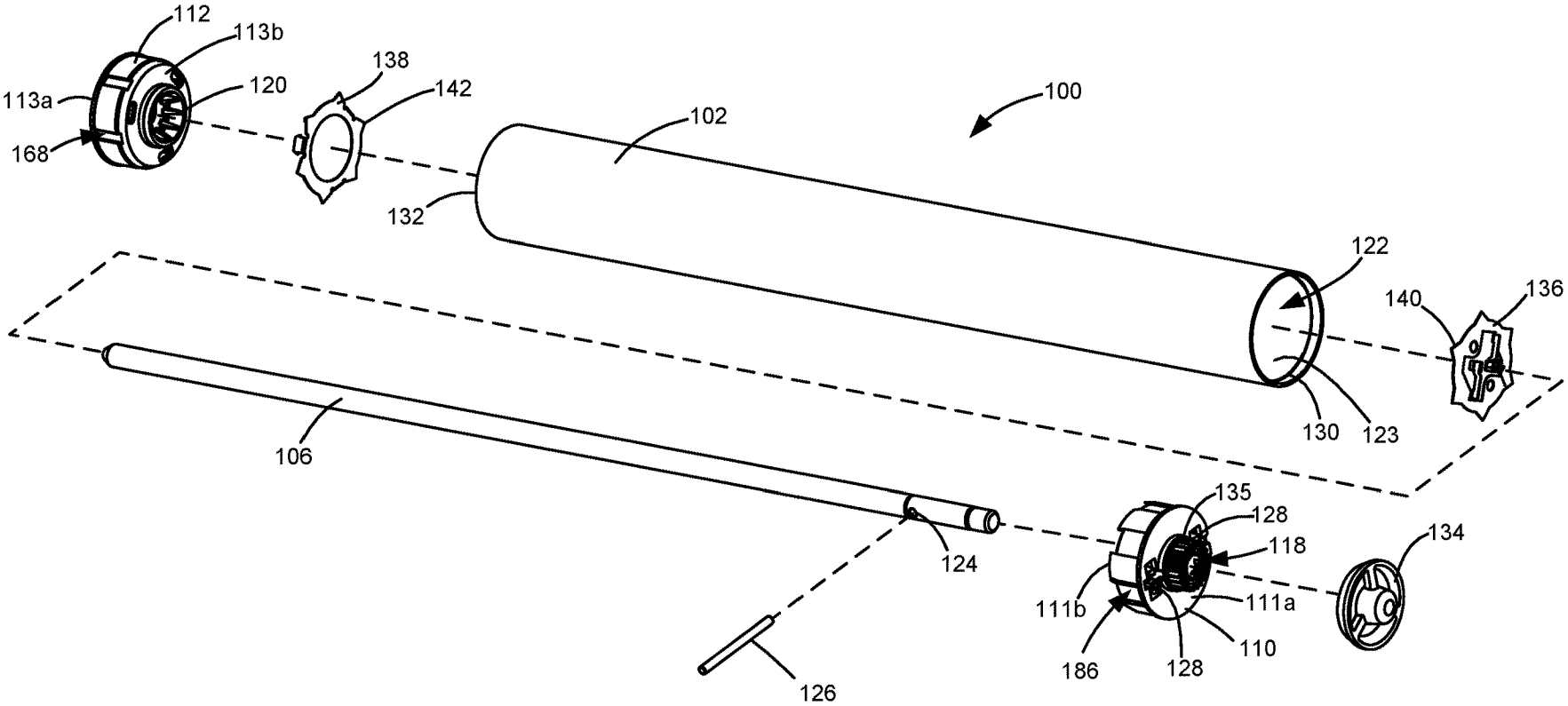
FIG. 2 is an exploded view of the photoconductive drum shown in FIG. 1.

FIG. 1 shows a photoconductive drum 100 for use in an electrophotographic image forming device according to one example embodiment. Photoconductive drum 100 includes a hollow, cylindrical drum member 102 having an outer circumferential surface 104. Photoconductive drum 100 includes a shaft 106 that defines a rotational axis 108 of photoconductive drum 100. An end cap 110, 112 is positioned at each axial end 114, 116 of photoconductive drum 100. With reference to FIGS. 1 and 2, each end cap 110, 112 includes an axially outboard side 111*a*, 113*a* and an axially inboard side 111*b*, 113*b*. In the example embodiment illustrated, shaft 106 passes through corresponding through-holes 118, 120 in end caps 110, 112 and through a hollow interior 122 of drum member 102.

In the example embodiment illustrated, shaft 106 includes a through-hole 124 that receives a corresponding pin 126. Pin 126 is received by a corresponding mount 128 on end cap 110 to rotatably couple shaft 106 to end cap 110 such that shaft 106 and end cap 110 rotate in unison. In the example embodiment illustrated, mount 128 includes a pair of snap-fit features positioned on axially outboard side 111*a* of end cap 110 that receive pin 126 and hold pin 126 in a fixed position relative to end cap 110. It will be appreciated that the present example is not limiting, and shaft 106 may be rotatably coupled to end cap 110 in any suitable manner. End caps 110, 112 matably fit within respective ends 130, 132 of the hollow interior 122 of drum member 102. In the example embodiment illustrated, end caps 110, 112 are held by a friction fit engagement with an inner circumferential surface 123 of drum member 102 to rotatably couple end caps 110, 112 with drum member 102 such that shaft 106, end caps 110, 112 and drum member 102 rotate in unison.

In the example embodiment illustrated, photoconductive drum 100 includes a drive coupler 134 at axial end 114 that is configured to mesh or mate with a corresponding drive coupler in the image forming device to receive rotational force from a drive train in the image forming device. Accordingly, axial end 114 may be referred to as the drive side of photoconductive drum 100, and axial end 116 may be referred to as the non-drive side of photoconductive drum 100. In the example embodiment illustrated, drive coupler 134 is press fit onto an axial end of shaft 106 such that drive coupler 134 is rotatably coupled to shaft 106 so that drive coupler 134 and shaft 106 rotate in unison. In the example embodiment illustrated, a drive coupler 135 is also positioned on axially outboard side 111*a* of end cap 110. Drive coupler 135 transfers rotational force from photoconductive drum 100 to one or more additional rotatable components of the image forming device. In the example embodiment illustrated, axial end 116 of photoconductive drum 100 does not include a drive coupler, but in other embodiments, axial end 116 of photoconductive drum 100 may also include a drive coupler, such as a gear, to transfer rotational force from photoconductive drum 100 to one or more additional rotatable components of the image forming device.

In the embodiment illustrated, shaft 106 is composed of an electrically conductive material, such as, for example, steel having nickel-phosphorous plating for corrosion protection. Shaft 106 is electrically connected to a power supply of the image forming device that provides an electrical voltage to shaft 106 in order to charge photoconductive drum 100 to a predetermined voltage. For example, in one embodiment, an exposed portion of shaft 106, such as at axial end 114 of photoconductive drum 100, may be positioned in an electrically conductive bearing that rotatably supports shaft 106 and provides an electrical connection to shaft 106. In another embodiment, an electrical contact, such as a metal spring or spring-biased metal tab, contacts an axial end of shaft 106, such as at axial end 116 of photoconductive drum 100, providing an electrical connection to shaft 106. It will be appreciated that the present examples are not limiting, and photoconductive drum 100 may be electrically connected to the power supply of the image forming device in any suitable manner.

Photoconductive drum 100 includes at least one electrical contact that electrically connects shaft 106 to drum member 102. In the example embodiment illustrated, photoconductive drum 100 includes a pair of electrical contacts 136, 138 that provide a redundant electrical connection from shaft 106 to drum member 102. Electrical contacts 136, 138 are each composed of an electrically conductive material, such as, for example, phosphor bronze. In the embodiment illustrated, each electrical contact 136, 138 includes a ring having a plurality of star-like projections 140, 142 that contact inner circumferential surface 123 of drum member 102 to provide an electrical connection to drum member 102. In the example embodiment illustrated, end cap 110 is composed of an electrically non-conductive material, such as a non-conductive plastic, for example, polyoxymethylene (POM). In this embodiment, electrical contact 136 directly contacts both shaft 106 and inner circumferential surface 123 of drum member 102 to provide a first electrical path from shaft 106 to drum member 102. In the example embodiment illustrated, end cap 112 is composed of an electrically conductive material, such as an electrically conductive plastic, for example, polyoxymethylene (POM) having one or more electrically conductive additives, such as carbon black. In this embodiment, electrical contact 138 contacts end cap 112 which, in turn, contacts shaft 106 such that end cap 112 and electrical contact 138 provide a second electrical path from shaft 106 to drum member 102. Electrical contacts 136, 138 help ensure that a consistent, reliable electrical connection is maintained to drum member 102 by providing multiple electrical connections between shaft 106 and drum member 102 in case one of the electrical connections between shaft 106 and drum member 102 is disrupted.

While the example embodiment illustrated includes an electrical contact 136 that is in direct electrical contact with both shaft 106 and drum member 102 and an electrical contact 138 that is in direct electrical contact with drum member 102 and indirect electrical contact with shaft 106, it will be appreciated that where photoconductive drum 100 includes multiple electrical contacts, such as electrical contacts 136, 138, any suitable combination of direct and indirect electrical connections may be used as desired. Further, while the example embodiment illustrated includes a pair of electrical contacts 136, 138 providing a redundant electrical connection between shaft 106 and drum member 102, a single electrical contact, such as electrical contact 136 or electrical contact 138, may be used as desired.

Figure 3:
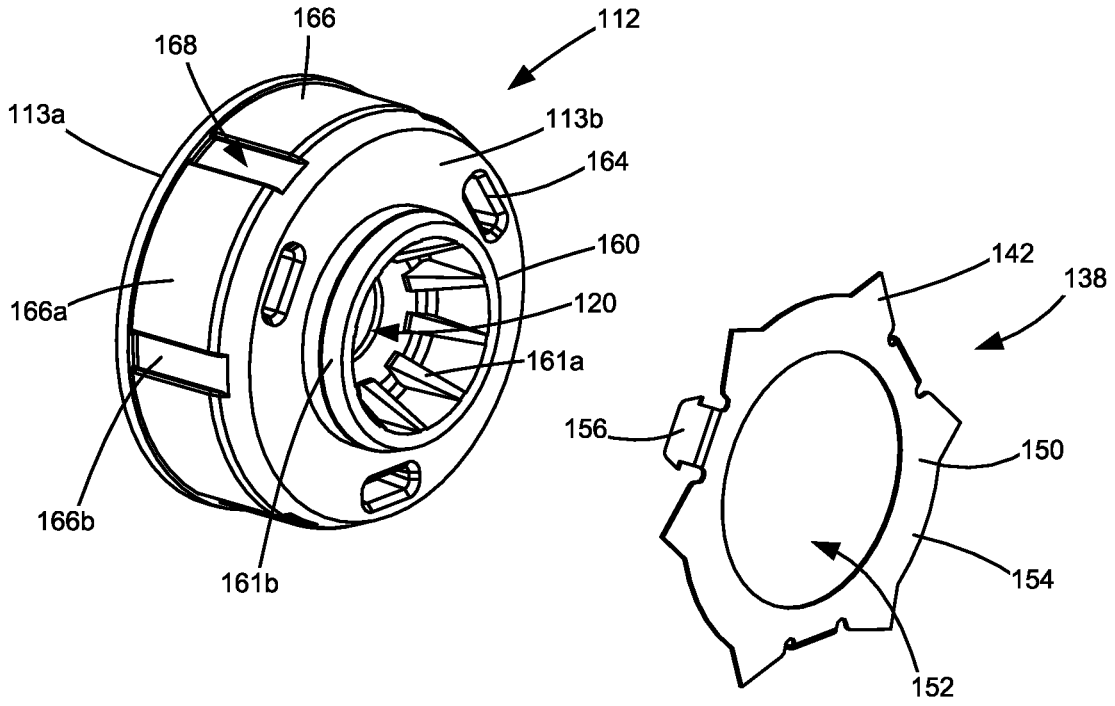
FIGS. 3 and 4 are exploded views of an end cap and an electrical contact positioned at a non-drive side of the photoconductive drum shown in FIGS. 1 and 2.
Figure 4:
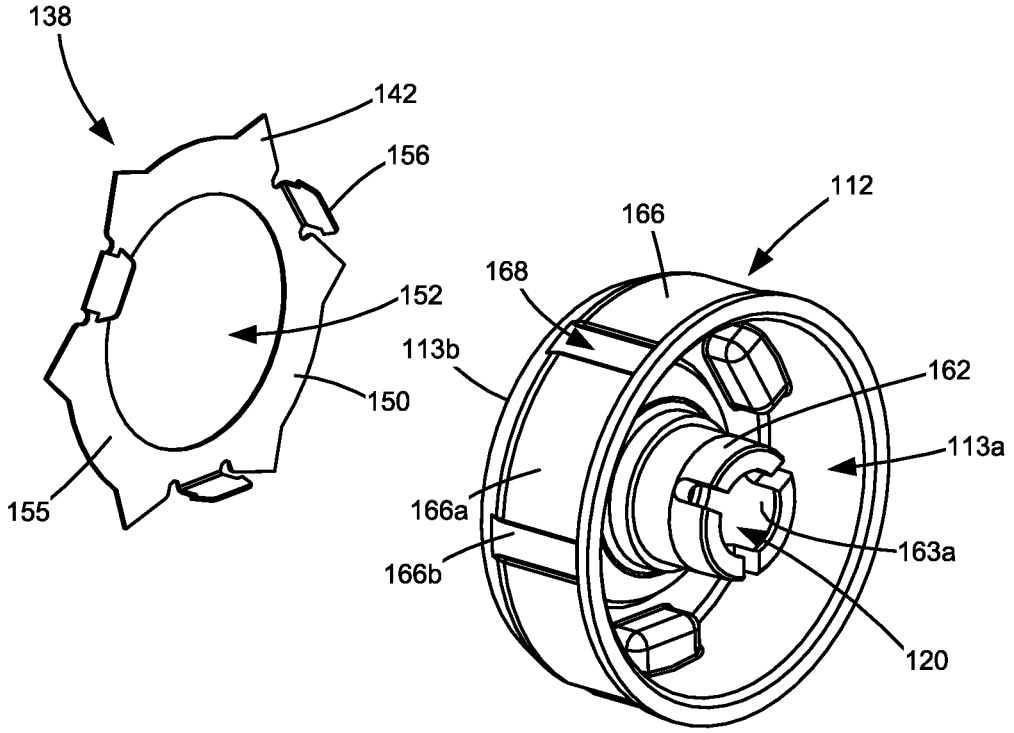

FIGS. 3 and 4 show end cap 112 and electrical contact 138 of photoconductive drum 100 in greater detail according to one example embodiment. Electrical contact 138 includes a ring-shaped body 150 having a center opening 152 therethrough that is centered around rotational axis 108 of photoconductive drum 100. Body 150 includes projections 142 extending radially outward, away from center opening 152. In the embodiment illustrated, each projection 142 has a triangular cross-section and a pointed apex or tip; however, other shapes may be used as desired. The present embodiment includes six projections 142 spaced substantially equally around center opening 152; however, more or fewer projections 142 may be used as desired. Electrical contact 138 has an axially inboard side 154 and an axially outboard side 155. In the embodiment illustrated, body 150 includes mounting tabs 156 that extend axially outward along rotational axis 108, toward end cap 112. The present embodiment includes three mounting tabs 156 spaced substantially equally around center opening 152; however, more or fewer mounting tabs 156 may be used as desired.

Electrical contact 138 is positioned against axially inboard side 113*b* of end cap 112. As discussed above, end cap 112 includes through-hole 120 that is centered around rotational axis 108 of photoconductive drum 100 and sized to receive shaft 106. In the embodiment illustrated, a collar 160 on axially inboard side 113*b* of end cap 112 includes an inner surface 161*a* having a diameter that tapers inward along an axial outward direction from axially inboard side 113*b* of end cap 112 toward axially outboard side 113*a* of end cap 112 in order to facilitate insertion of shaft 106 into through-hole 120. In the embodiment illustrated, through-hole 120 is formed in a boss 162 that extends axially outward from axially outboard side 113*a* of end cap 112. An inner surface 163*a* of boss 162 forming though-hole 120 is sized to closely receive and contact shaft 106 in order to electrically connect shaft 106 and end cap 112. In the embodiment illustrated, shaft 106 protrudes through through-hole 120 in boss 162 such that an axial end of shaft 106 is exposed on axially outboard side 113*a* of end cap 112. However, in other embodiments, the axial end of shaft 106 may be received in a recess formed in end cap 112, such as a bearing formed in boss 162, rather than protruding through a through-hole 120 in end cap 112.

In the embodiment illustrated, end cap 112 includes mounting slots 164 formed in axially inboard side 113*b* of end cap 112 that closely and matably receive mounting tabs 156 of electrical contact 138. The engagement between mounting tabs 156 of electrical contact 138 and mounting slots 164 of end cap 112 attaches electrical contact 138 to end cap 112 and prevents electrical contact 138 from rotating relative to end cap 112 or separating from end cap 112 during operation of photoconductive drum 100. The present embodiment includes three mounting slots 164 spaced substantially equally around collar 160; however, more or fewer mounting slots 164 may be used as desired. It will also be appreciated that electrical contact 138 may be attached to end cap 112 by any other suitable method as desired. In the present embodiment, center opening 152 of electrical contact 138 encircles and is spaced from an outer circumferential surface 161*b* of collar 160 of end cap 112. However, in other embodiments, electrical contact 138 may be retained on end cap 112 by way of a friction fit between a surface of body 150 forming center opening 152 and outer circumferential surface 161*b* of collar 160.

End cap 112 includes an outer circumferential surface 166 that extends between axially inboard side 113*b* of end cap 112 and axially outboard side 113*a* of end cap 112. Outer circumferential surface 166 is sized to form a friction fit with inner circumferential surface 123 of drum member 102 at end 132 of drum member 102 in order to physically retain end cap 112 and electrical contact 138 on drum member 102 at axial end 116 of photoconductive drum 100. Outer circumferential surface 166 of end cap 112 includes recesses or grooves 168 therein that extend in an axial direction from axially inboard side 113*b* of end cap 112 toward axially outboard side 113*a* of end cap 112.

Figure 5:
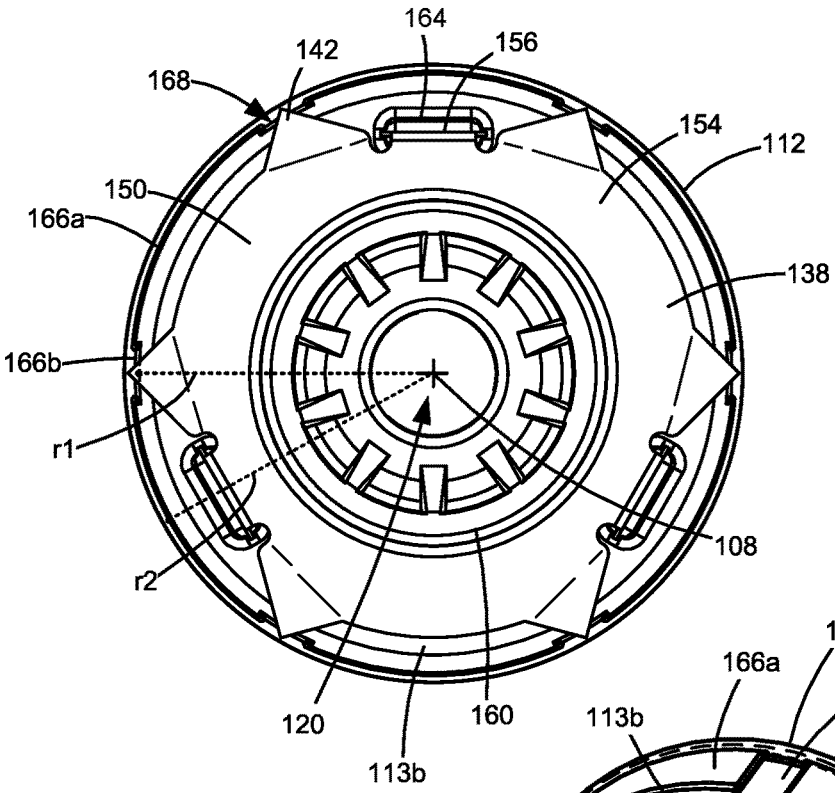
FIG. 5 is an elevation view of the end cap and the electrical contact shown in FIGS. 3 and 4.

With reference to FIG. 5, grooves 168 have a recessed or reduced radial dimension in comparison with a contact portion 166*a* of outer circumferential surface 166 that contacts inner circumferential surface 123 of drum member 102 such that a radial distance r1 from rotational axis 108 (and from a center of center opening 152 of electrical contact 138 and a center of through-hole 120 of end cap 112) to a recessed portion 166*b* of outer circumferential surface 166 positioned within groove 168 is less than a radial distance r2 from rotational axis 108 (and from a center of center opening 152 of electrical contact 138 and a center of through-hole 120 of end cap 112) to contact portion 166*a* of outer circumferential surface 166. Grooves 168 are angularly aligned with projections 142 of electrical contact 138. Projections 142 extend radially beyond grooves 168 such that each projection 142 extends further outward radially than recessed portion 166*b* of outer circumferential surface 166 of the corresponding groove 168.

Figure 6:
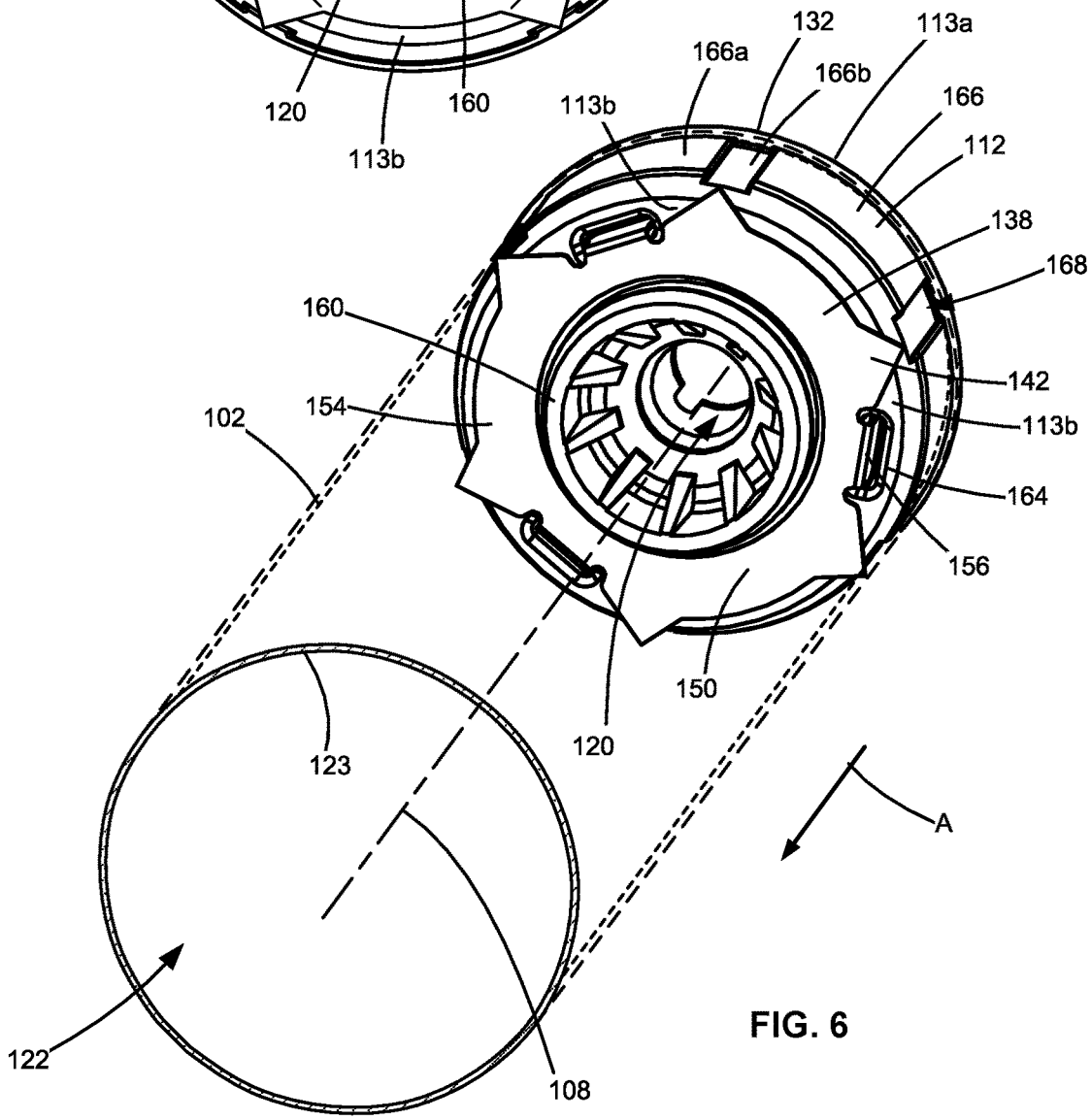
FIG. 6 is a perspective view of the end cap and the electrical contact shown in FIGS. 3-5.

FIG. 6 shows end cap 112 and electrical contact 138 installed on drum member 102 with drum member 102 illustrated in broken line. To assemble photoconductive drum 100, electrical contact 138 is mounted onto end cap 112, for example, by aligning and inserting mounting tabs 156 of electrical contact 138 with and into mounting slots 164 of end cap 112. End cap 112 and electrical contact 138 are pressed into end 132 of interior 122 of drum member 102 in an insertion direction A along rotational axis 108 with axially inboard sides 154, 113*b* of electrical contact 138 and end cap 112 leading. In the embodiment illustrated, projections 142 of electrical contact 138 have an interference fit with inner circumferential surface 123 of drum member 102 such that projections 142 press into inner circumferential surface 123 of drum member 102 as end cap 112 and electrical contact 138 are inserted into interior 122 of drum member 102. The interference fit between projections 142 of electrical contact 138 and inner circumferential surface 123 of drum member 102 helps maintain consistent electrical contact between electrical contact 138 and drum member 102.

The contact between projections 142 of electrical contact 138 and inner circumferential surface 123 of drum member 102 may tend to scratch the portions of inner circumferential surface 123 along which projections 142 drag during insertion of end cap 112 and electrical contact 138 into end 132 of interior 122 of drum member 102, which may cause metal burs or the like on inner circumferential surface 123 of drum member 102. Grooves 168 are positioned so that any burs or deformations on inner circumferential surface 123 of drum member 102 do not contact outer circumferential surface 166 of end cap 112 during insertion of end cap 112 and electrical contact 138 into end 132 of interior 122 of drum member 102. Because grooves 168 of end cap 112 are angularly aligned with projections 142 of electrical contact 138, burs caused by projections 142 on inner circumferential surface 123 of drum member 102 tend to pass recessed portion 166*b* formed by grooves 168 in a spaced relationship from outer circumferential surface 166 of end cap 112 as end cap 112 and electrical contact 138 are inserted into end 132 of interior 122 of drum member 102. Otherwise, contact between burs on inner circumferential surface 123 of drum member 102 and outer circumferential surface 166 of end cap 112 could tend to shave material away from outer circumferential surface 166 of end cap 112. Material shaved away from end cap 112 can create debris in the image forming device which can contaminate imaging components, potentially causing print defects. Electrically conductive debris, as in the case of the example end cap 112, can also cause electrical shorts within the image forming device, potentially disrupting the electrical connections to one or more imaging components and causing print defects. Grooves 168 on outer circumferential surface 166 of end cap 112 help reduce the occurrence of contact between burs or other deformities on inner circumferential surface 123 of drum member 102 with outer circumferential surface 166 of end cap 112 in order to help reduce debris and avoid electrical shorts within the image forming device.

Figure 7:
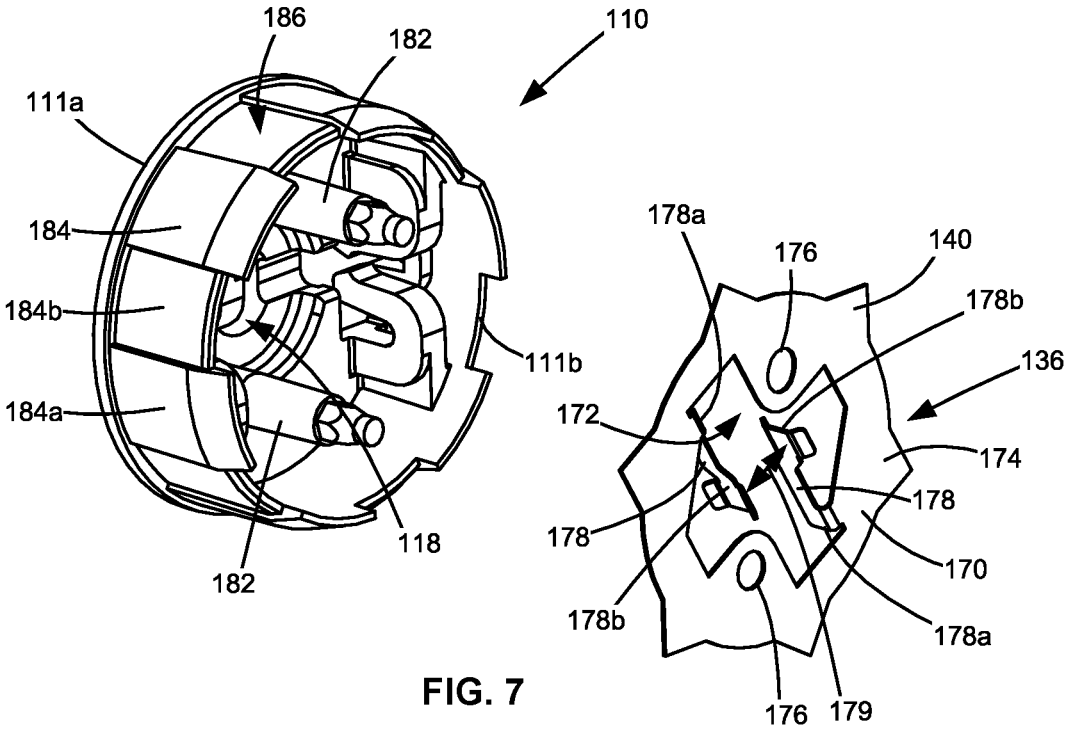
FIGS. 7 and 8 are exploded views of an end cap and an electrical contact positioned at a drive side of the photoconductive drum shown in FIGS. 1 and 2.
Figure 8:
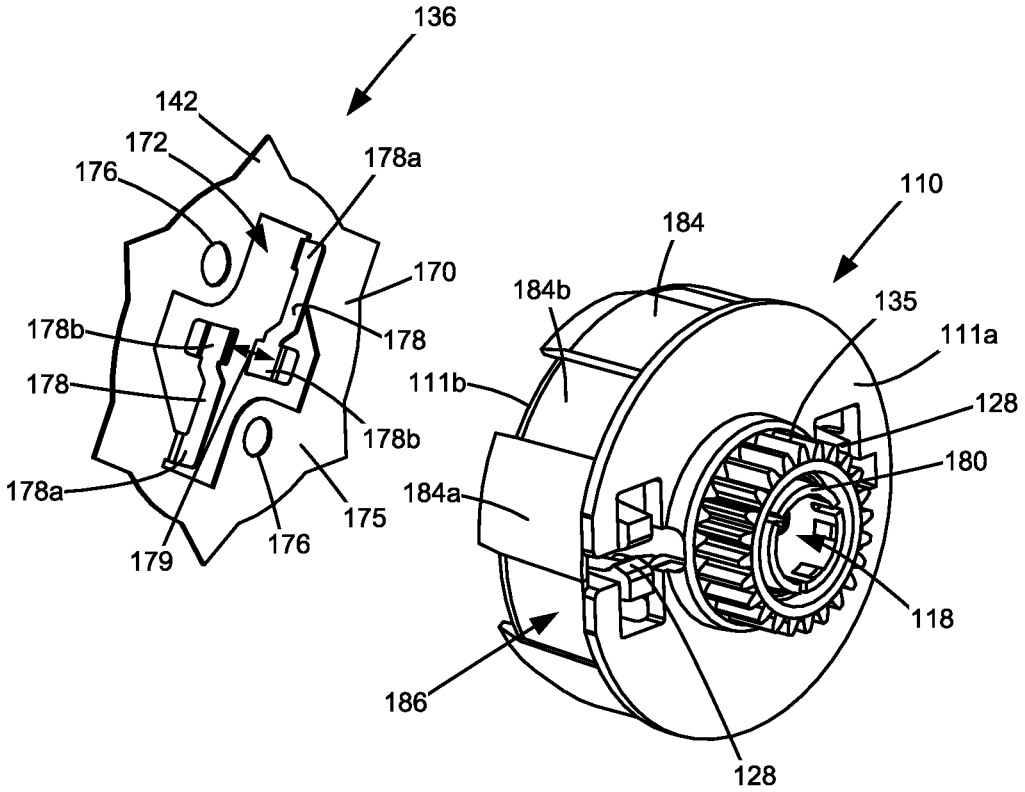

FIGS. 7 and 8 show end cap 110 and electrical contact 136 of photoconductive drum 100 in greater detail according to one example embodiment. Electrical contact 136 includes a ring-shaped body 170 having a center opening 172 therethrough that is centered around rotational axis 108 of photoconductive drum 100. Body 170 includes projections 140 extending radially outward, away from center opening 172. In the embodiment illustrated, each projection 140 has a triangular cross-section and a pointed apex or tip; however, other shapes may be used as desired. The present embodiment includes six projections 140 spaced substantially equally around center opening 172; however, more or fewer projections 140 may be used as desired. Electrical contact 136 has an axially inboard side 174 and an axially outboard side 175. In the embodiment illustrated, body 170 includes mounting holes 176 therein. The present embodiment includes a pair of mounting holes 176 positioned on opposite sides of opening 172; however, more or fewer mounting holes 176 may be used as desired. In the embodiment illustrated, body 170 also includes a pair of opposed contact arms 178 that extend in a cantilevered manner into opening 172. Each contact arm 178 includes a proximate end 178*a* and a distal end 178*b*. Distal ends 178*b* of contact arms 178 are spaced from each other forming a gap 179 therebetween. Gap 179 is positioned at a center of body 170 and is sized to closely receive shaft 106 of photoconductive drum 100 such that contact between distal ends 178*b* of contact arms 178 and shaft 106 electrically connects electrical contact 136 to shaft 106.

Electrical contact 136 is positioned against axially inboard side 111*b* of end cap 110. As discussed above, end cap 110 includes through-hole 118 that is centered around rotational axis 108 of photoconductive drum 100 and sized to receive shaft 106. In the embodiment illustrated, through-hole 118 is formed in a boss 180 that extends axially outward from axially outboard side 111*a* of end cap 110. In the embodiment illustrated, shaft 106 protrudes through through-hole 118 in boss 180 such that an axial end of shaft 106 is exposed on axially outboard side 111*a* of end cap 110. However, in other embodiments, the axial end of shaft 106 may be received in a recess formed in end cap 110, such as a bearing formed in boss 180, rather than protruding through a through-hole 118 in end cap 110.

In the embodiment illustrated, end cap 110 includes drive coupler 135 in the form of a gear positioned on axially outboard side 111*a* of end cap 110. In this embodiment, drive coupler 135 is centered around rotational axis 108 of photoconductive drum 100 and a center of through-hole 118. As discussed above, in this embodiment, end cap 110 also includes mount 128 positioned on axially outboard side 111*a* of end cap 110 that receives pin 126 to rotatably couple shaft 106 to end cap 110.

In the embodiment illustrated, end cap 110 includes mounting posts 182 positioned on axially inboard side 111*b* of end cap 110 that are matably received by mounting holes 176 of electrical contact 136. The engagement between mounting holes 176 of electrical contact 136 and mounting posts 182 of end cap 110 attaches electrical contact 136 to end cap 110 and prevents electrical contact 136 from rotating relative to end cap 110 or separating from end cap 110 during operation of photoconductive drum 100. The present embodiment includes two mounting posts 182 positioned on opposite sides of through-hole 118; however, more or fewer mounting posts 182 may be used as desired. It will also be appreciated that electrical contact 136 may be attached to end cap 110 by any other suitable method as desired.

End cap 110 includes an outer circumferential surface 184 that extends between axially inboard side 111*b* of end cap 110 and axially outboard side 111*a* of end cap 110. Outer circumferential surface 184 is sized to form a friction fit with inner circumferential surface 123 of drum member 102 at end 130 of drum member 102 in order to physically retain end cap 110 and electrical contact 136 on drum member 102 at axial end 114 of photoconductive drum 100. Like outer circumferential surface 166 of end cap 112 discussed above, outer circumferential surface 184 of end cap 110 includes recesses or grooves 186 therein that extend in an axial direction from axially inboard side 111*b* of end cap 110 toward axially outboard side 111*a* of end cap 110.

Figure 9:
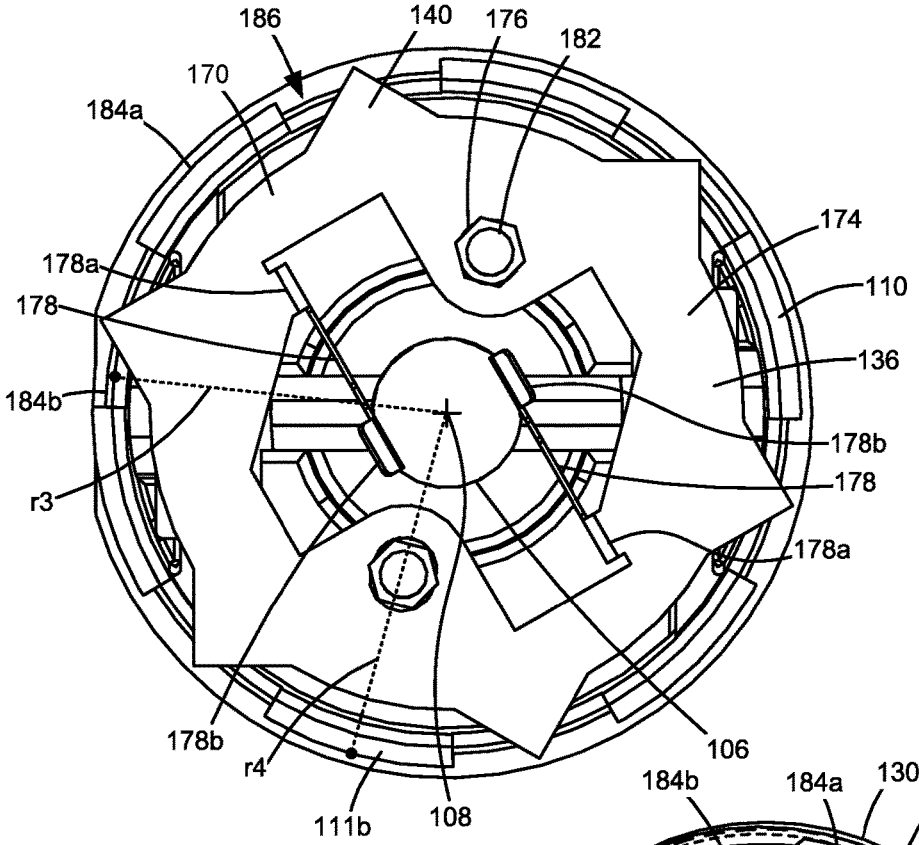
FIG. 9 is an elevation view of the end cap and the electrical contact shown in FIGS. 7 and 8 installed on a shaft of the photoconductive drum.

With reference to FIG. 9, grooves 186 have a recessed or reduced radial dimension in comparison with a contact portion 184*a* of outer circumferential surface 184 that contacts inner circumferential surface 123 of drum member 102 such that a radial distance r3 from rotational axis 108 (and from a center of center opening 172 of electrical contact 136 and a center of through-hole 118 of end cap 110) to a recessed portion 184*b* of outer circumferential surface 184 positioned within groove 186 is less than a radial distance r4 from rotational axis 108 (and from a center of center opening 172 of electrical contact 136 and a center of through-hole 118 of end cap 110) to contact portion 184*a* of outer circumferential surface 184. Grooves 186 are angularly aligned with projections 140 of electrical contact 136. Projections 140 extend radially beyond grooves 186 such that each projection 140 extends further outward radially than recessed portion 184*b* of outer circumferential surface 184 of the corresponding groove 186.

Figure 10:
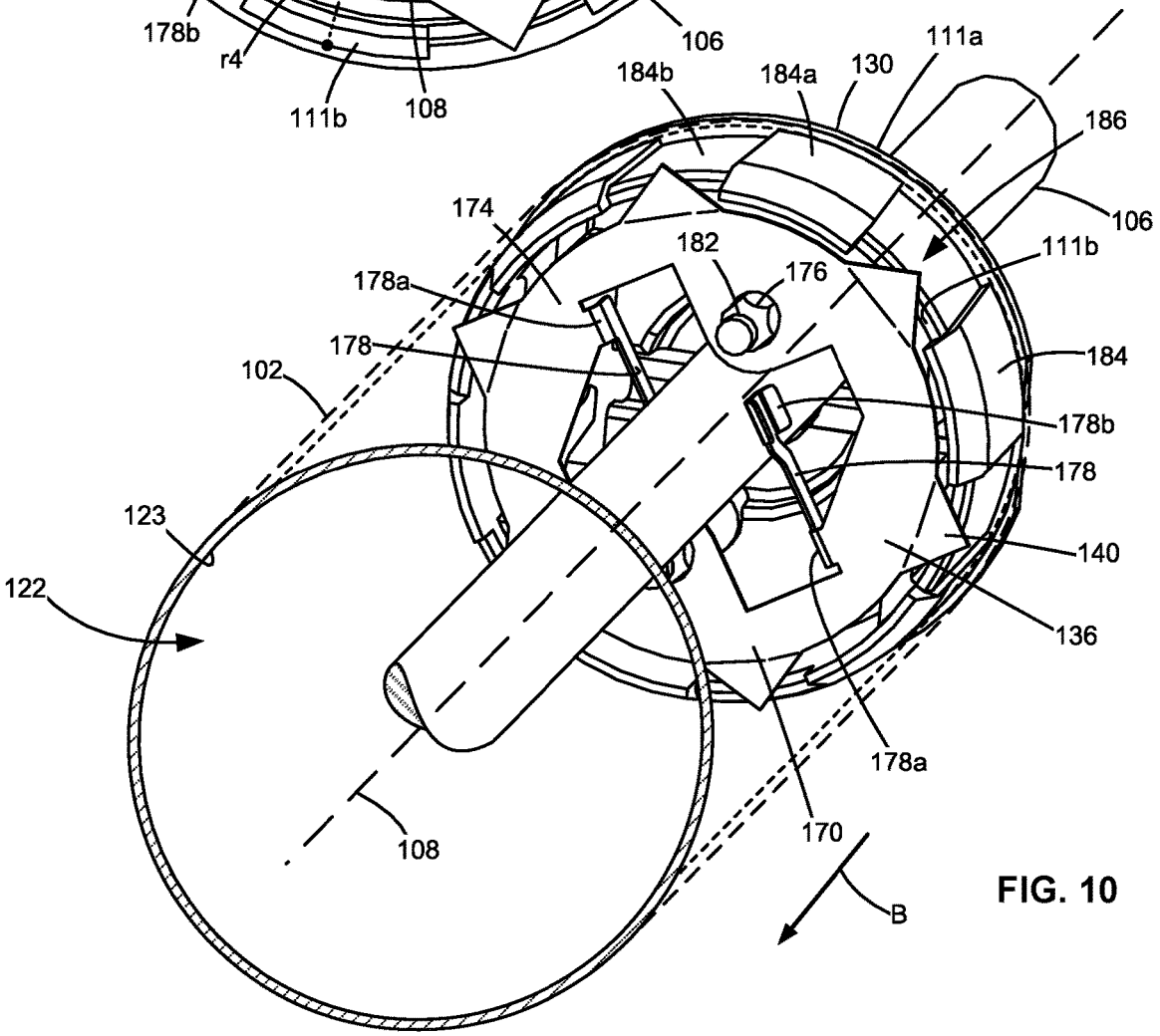
FIG. 10 is a perspective view of the end cap and the electrical contact shown in FIGS. 7-9 installed on a shaft of the photoconductive drum.

FIG. 10 shows end cap 110 and electrical contact 136 installed on drum member 102 and shaft 106 with drum member 102 illustrated in broken line. To assemble photoconductive drum 100, electrical contact 136 is mounted onto end cap 110, for example, by aligning and inserting mounting posts 182 of end cap 110 with and into mounting holes 176 of electrical contact 136. End cap 110 and electrical contact 136 are pressed into end 130 of interior 122 of drum member 102 in an insertion direction B along rotational axis 108 with axially inboard sides 174, 111*b* of electrical contact 136 and end cap 110 leading. Shaft 106 is inserted into through-hole 118 of end cap 110 and extended into through-hole 120 of end cap 112. Pin 126 on shaft 106 is aligned with and pressed into mount 128 on end cap 110, which rotatably couples shaft 106 to end cap 110 and retains the axial position of shaft 106 relative to end cap 110. As discussed above, shaft 106 contacts distal ends 178*b* of contact arms 178 of electrical contact 136, electrically connecting shaft 106 to electrical contact 136.

In the embodiment illustrated, projections 140 of electrical contact 136 have an interference fit with inner circumferential surface 123 of drum member 102 such that projections 140 press into inner circumferential surface 123 of drum member 102 as end cap 110 and electrical contact 136 are inserted into interior 122 of drum member 102 as discussed above with respect to projections 142 of electrical contact 138. The interference fit between projections 140 of electrical contact 136 and inner circumferential surface 123 of drum member 102 helps maintain consistent electrical contact between electrical contact 136 and drum member 102.

As discussed with respect to grooves 168 on end cap 112, grooves 186 are positioned so that any burs or deformations caused by projections 140 of electrical contact 136 on inner circumferential surface 123 of drum member 102 do not contact outer circumferential surface 184 of end cap 110 during insertion of end cap 110 and electrical contact 136 into end 130 of interior 122 of drum member 102. As explained above, because grooves 186 of end cap 110 are angularly aligned with projections 140 of electrical contact 136, burs caused by projections 140 on inner circumferential surface 123 of drum member 102 tend to pass recessed portion 184*b* formed by grooves 186 in a spaced relationship from outer circumferential surface 184 of end cap 110 as end cap 110 and electrical contact 136 are inserted into end 130 of interior 122 of drum member 102. Like grooves 168 of end cap 112, grooves 186 on outer circumferential surface 184 of end cap 110 help reduce the occurrence of contact between burs or other deformities on inner circumferential surface 123 of drum member 102 with outer circumferential surface 184 of end cap 110 in order to help reduce debris within the image forming device.

Figure 11:
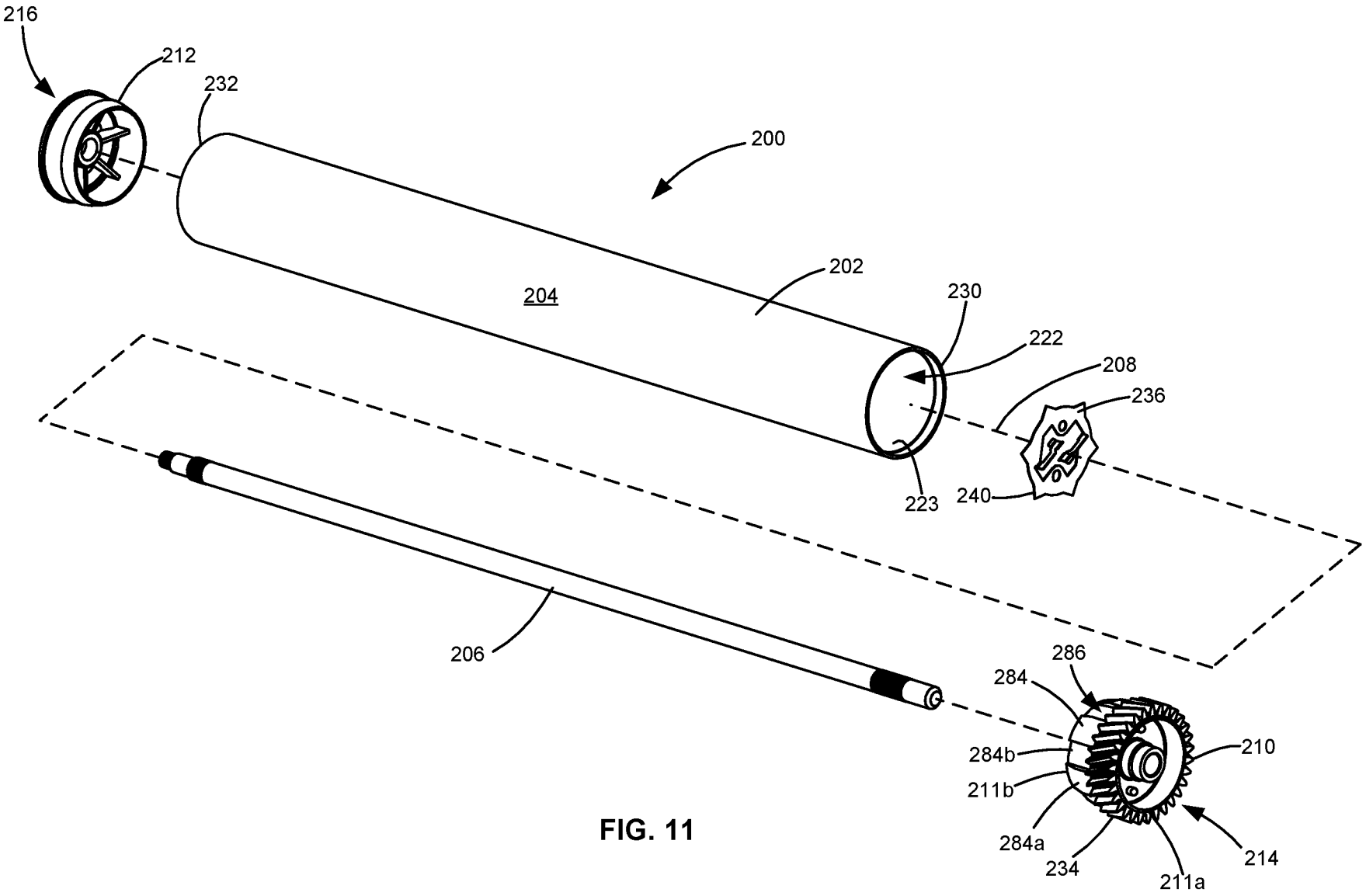
FIG. 11 is a perspective view of a photoconductive drum according to another example embodiment.

FIG. 11 shows a photoconductive drum 200 according to another example embodiment. Photoconductive drum 200 includes a hollow, cylindrical drum member 202 having an outer circumferential surface 204. Photoconductive drum 200 includes a shaft 206 that defines a rotational axis 208 of photoconductive drum 200. An end cap 210, 212 is positioned at each axial end 214, 216 of photoconductive drum 200. End caps 210, 212 matably fit within respective ends 230, 232 of a hollow interior 222 of drum member 202. In the example embodiment illustrated, end cap 210 includes a drive coupler 234, such as a gear.

Similar to shaft 106 discussed above, shaft 206 is composed of an electrically, conductive material and is electrically connected to a power supply of the image forming device. While the example photoconductive drum 100 discussed above included a pair of electrical contacts 136, 138; in the present embodiment, photoconductive drum 200 includes a single electrical contact 236 that provides an electrical connection from shaft 206 to drum member 202. In the example embodiment illustrated, electrical contact 236 is substantially the same as electrical contact 136 discussed above; however, other configurations may be used as desired. Electrical contact 236 is positioned against an axially inboard side 211*b* of end cap 210 and directly contacts both shaft 206 and inner circumferential surface 223 of drum member 202 to provide an electrical path from shaft 206 to drum member 202. In this embodiment, end caps 210; 212 may be composed of an electrically non-conductive material.

Like end caps 110, 112 discussed above, an outer circumferential surface 284 of end cap 210 includes recesses or grooves 286 therein that extend in an axial direction from axially inboard side 211*b* of end cap 210 toward an axially outboard side 211*a* of end cap 210. Recessed portions 284*b* of outer circumferential surface 284 formed by grooves 286 have a reduced radial dimension in comparison with a contact portion 284*a* of outer circumferential surface 284 that contacts inner circumferential surface 223 of drum member 202. Grooves 286 are positioned so that any burs or deformations caused by projections 240 of electrical contact 236 on inner circumferential surface 223 of drum member 202 do not contact outer circumferential surface 284 of end cap 210 during insertion of end cap 210 and electrical contact 236 into end 230 of interior 222 of drum member 202. Like grooves 168, 186 discussed above, grooves 286 on outer circumferential surface 284 of end cap 210 help reduce debris within the image forming device.

Figure 12:
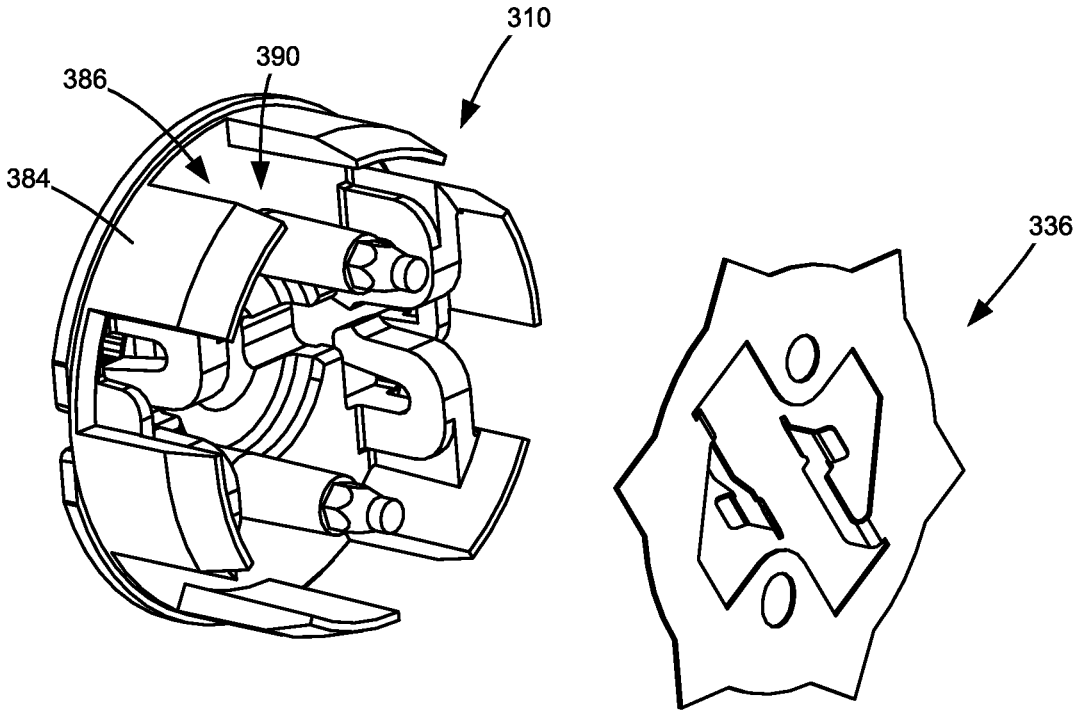
FIG. 12 is an exploded view of an end cap and an electrical contact according to another example embodiment.
Figure 13:
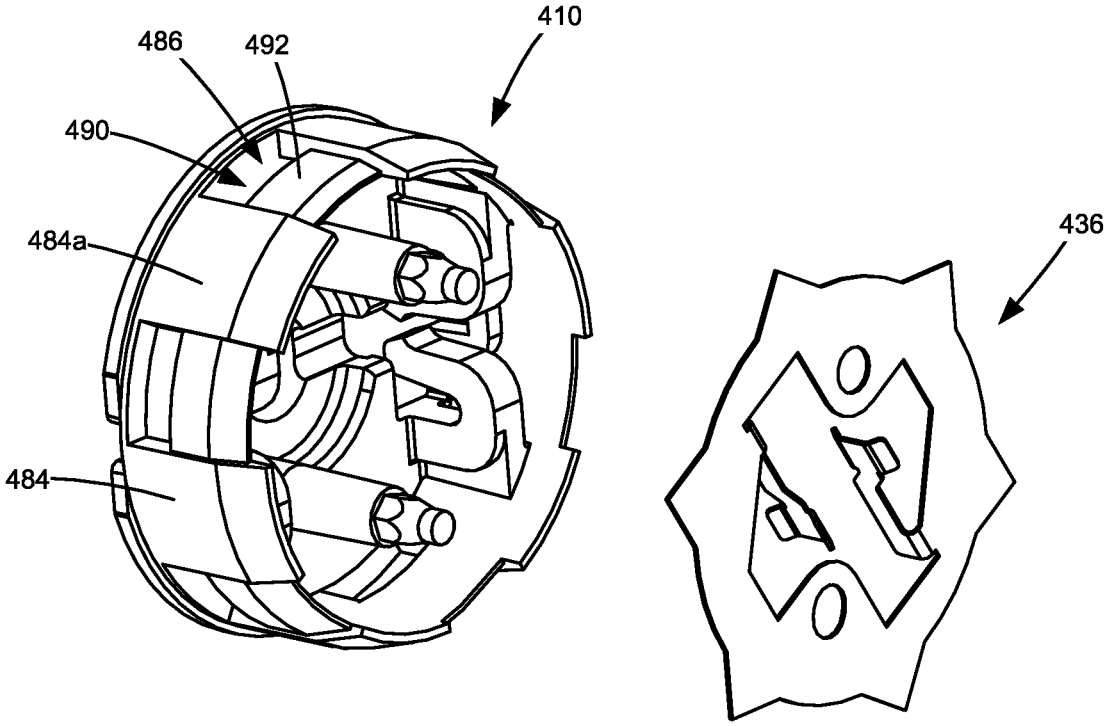
FIG. 13 is an exploded view of an end cap and an electrical contact according to another example embodiment.

While the example embodiments discussed above includes grooves, such as grooves 168 of end cap 112, grooves 186 of end cap 110, and grooves 286 of end cap 210, that are formed by a continuous, recessed surface, such as recessed portion 166*b* of end cap 112 and recessed portion 184*b* of end cap 110, it will be appreciated that grooves may be formed in either or both end caps of a photoconductive according to any suitable construction as desired. For example, FIG. 12 shows an end cap 310 and corresponding electrical contact 336 according to another example embodiment. In this example embodiment, grooves 386 of end cap 310 are formed by gaps or cutouts 390 in outer circumferential surface 384 of end cap 310. FIG. 13 shows an end cap 410 and corresponding electrical contact 436 according to another example embodiment. In this example embodiment, grooves 486 of end cap 410 include recessed support linkages or beams 492 positioned in each cutout 490 in outer circumferential surface 484 of end cap 410. Beams 492 extend between adjacent segments of contact portion 484*a* of outer circumferential surface 484.

The foregoing description illustrates various aspects of the present disclosure. It is not intended to be exhaustive. Rather, it is chosen to illustrate the principles of the present disclosure and its practical application to enable one of ordinary skill in the art to utilize the present disclosure, including its various modifications that naturally follow. All modifications and variations are contemplated within the scope of the present disclosure as determined by the appended claims. Relatively apparent modifications include combining one or more features of various embodiments with features of other embodiments.

The invention claimed is:

1. A photoconductive drum for an electrophotographic image forming device, comprising:

a cylindrical drum member;

a shaft defining a rotational axis of the photoconductive drum;

an end cap positioned at an axial end of the drum member;

an electrical contact positioned against an axially inboard side of the end cap, the electrical contact electrically connects the shaft to the drum member, the electrical contact includes a plurality of projections that contact an inner circumferential surface of the drum member; and a plurality of grooves formed in an outer circumferential surface of the end cap, the plurality of grooves extend in an axial direction relative to the rotational axis of the photoconductive drum, the plurality of grooves are angularly aligned with the plurality of projections of the electrical contact, wherein the end cap is composed of an electrically conductive material.

2. The photoconductive drum of claim 1, wherein the electrical contact directly contacts the shaft.

3. The photoconductive drum of claim 1, wherein contact portions of the outer circumferential surface of the end cap are in contact with the inner circumferential surface of the drum member such that the end cap is retained on the drum member by a friction fit engagement between the contact portions of the outer circumferential surface of the end cap and the inner circumferential surface of the drum member.

4. The photoconductive drum of claim 1, wherein the plurality of grooves are formed by recessed portions of the outer circumferential surface of the end cap, and the plurality of projections of the electrical contact extend further outward radially relative to the rotational axis of the photoconductive drum than the recessed portions of the outer circumferential surface of the end cap.

5. The photoconductive drum of claim 1, wherein the plurality of grooves include cutouts through the outer circumferential surface of the end cap.

6. A photoconductive drum for an electrophotographic image forming device, comprising:

a cylindrical drum member;

a shaft defining a rotational axis of the photoconductive drum;

an end cap positioned at an axial end of the drum member; and an electrical contact positioned against an axially inboard side of the end cap, the electrical contact electrically connects the shaft to the drum member, the electrical contact includes a plurality of projections that contact an inner circumferential surface of the drum member, wherein contact portions of an outer circumferential surface of the end cap are in contact with the inner circumferential surface of the drum member, recessed portions of the outer circumferential surface of the end cap are angularly aligned with the plurality of projections of the electrical contact, the recessed portions of the outer circumferential surface of the end cap are spaced from the inner circumferential surface of the drum member, wherein the end cap is composed of an electrically conductive material.

7. The photoconductive drum of claim 6, wherein the electrical contact directly contacts the shaft.

8. The photoconductive drum of claim 6, wherein the end cap is retained on the drum member by a friction fit engagement between the contact portions of the outer circumferential surface of the end cap and the inner circumferential surface of the drum member.

9. A photoconductive drum for an electrophotographic image forming device, comprising:

a cylindrical drum member;

a shaft defining a rotational axis of the photoconductive drum;

an end cap positioned at an axial end of the drum member;

an electrical contact positioned against an axially inboard side of the end cap, the electrical contact electrically connects the shaft to the drum member, the electrical contact includes a plurality of projections that contact an inner circumferential surface of the drum member; and a plurality of grooves formed in an outer circumferential surface of the end cap, the plurality of grooves are aligned with the plurality of projections of the electrical contact such that deformities on the inner circumferential surface of the drum member caused by contact with the plurality of projections of the electrical contact do not contact the outer circumferential surface of the end cap when the end cap is pressed into the axial end of the drum member in an axial direction relative to the rotational axis of the photoconductive drum, wherein the end cap is composed of an electrically conductive material.

10. The photoconductive drum of claim 9, wherein the electrical contact directly contacts the shaft.

11. The photoconductive drum of claim 9, wherein contact portions of the outer circumferential surface of the end cap are in contact with the inner circumferential surface of the drum member such that the end cap is retained on the drum member by a friction fit engagement between the contact portions of the outer circumferential surface of the end cap and the inner circumferential surface of the drum member.

12. The photoconductive drum of claim 9, wherein the plurality of grooves are formed by recessed portions of the outer circumferential surface of the end cap, and the plurality of projections of the electrical contact extend further outward radially relative to the rotational axis of the photoconductive drum than the recessed portions of the outer circumferential surface of the end cap.

13. The photoconductive drum of claim 9, wherein the plurality of grooves include cutouts through the outer circumferential surface of the end cap.

14. A photoconductive drum for an electrophotographic image forming device, comprising:

a cylindrical drum member;

a shaft defining a rotational axis of the photoconductive drum;

an end cap positioned at an axial end of the drum member;

an electrical contact positioned against an axially inboard side of the end cap, the electrical contact electrically connects the shaft to the drum member, the electrical contact includes a plurality of projections that contact an inner circumferential surface of the drum member; and a plurality of grooves formed in an outer circumferential surface of the end cap, the plurality of grooves are aligned with the plurality of projections of the electrical contact such that deformities on the inner circumferential surface of the drum member caused by contact with the plurality of projections of the electrical contact do not contact the outer circumferential surface of the end cap when the end cap is pressed into the axial end of the drum member in an axial direction relative to the rotational axis of the photoconductive drum, wherein the electrical contact directly contacts the shaft.

15. A photoconductive drum for an electrophotographic image forming device, comprising:

a cylindrical drum member;

a shaft defining a rotational axis of the photoconductive drum;

an end cap positioned at an axial end of the drum member;

an electrical contact positioned against an axially inboard side of the end cap, the electrical contact electrically connects the shaft to the drum member, the electrical contact includes a plurality of projections that contact an inner circumferential surface of the drum member; and a plurality of grooves formed in an outer circumferential surface of the end cap, the plurality of grooves extend in an axial direction relative to the rotational axis of the photoconductive drum, the plurality of grooves are angularly aligned with the plurality of projections of the electrical contact, wherein the electrical contact directly contacts the shaft.

16. A photoconductive drum for an electrophotographic image forming device, comprising:

a cylindrical drum member;

a shaft defining a rotational axis of the photoconductive drum;

an end cap positioned at an axial end of the drum member; and an electrical contact positioned against an axially inboard side of the end cap, the electrical contact electrically connects the shaft to the drum member, the electrical contact includes a plurality of projections that contact an inner circumferential surface of the drum member, wherein contact portions of an outer circumferential surface of the end cap are in contact with the inner circumferential surface of the drum member, recessed portions of the outer circumferential surface of the end cap are angularly aligned with the plurality of projections of the electrical contact, the recessed portions of the outer circumferential surface of the end cap are spaced from the inner circumferential surface of the drum member, wherein the electrical contact directly contacts the shaft.

* * * * *